US005503415A

United States Patent [19]

Powell

[11] Patent Number: 5,503,415

[45] Date of Patent: Apr. 2, 1996

[54] METHOD FOR USING A CREEPER WITH REMOVABLE TOOL CARRIER

[76] Inventor: Eugene I. Powell, 273 Christopher Ave., Campbell, Calif. 95008

[21] Appl. No.: 489,538

[22] Filed: Jun. 12, 1995

[51] Int. Cl.[6] ..... B25H 5/00

[52] U.S. Cl. ..... 280/32.6

[58] Field of Search ..... 280/32.6; D34/23

[56] References Cited

U.S. PATENT DOCUMENTS

| | | | |
|---|---|---|---|
| 270,962 | 10/1983 | Kitchener | D34/23 |
| 1,184,487 | 5/1916 | Peterson | 280/32.6 |
| 4,986,558 | 1/1991 | Morris | 280/32.6 |
| 5,078,280 | 1/1992 | Nordeen | 280/32.6 |
| 5,174,592 | 12/1992 | Pool | 280/32.6 |

*Primary Examiner*—Mitchell J. Hill
*Attorney, Agent, or Firm*—Robert Samuel Smith

[57] ABSTRACT

An auto mechanics creeper having side rails such that trays may be temporarily attached to either rail by sliding a lip of the respective tray into a slot between the creeper platform and the rail.

7 Claims, 1 Drawing Sheet

METHOD FOR USING A CREEPER WITH REMOVABLE TOOL CARRIER

FIELD OF THE INVENTION

This invention relates to a creeper such as are used to repair automobiles and particularly to a creeper with at least one positionable and removable tray for carrying tools.

PRIOR ART AND INFORMATION DISCLOSURE

Automobile mechanics frequently use a creeper to enable them to lie under an automobile to make various repairs. A creeper is a platform mounted on casters such that the mechanic, lying on the platform, can conveniently roll from one location to another while working on the underside of the car. Various creepers have appeared on the market with various modifications such as molding the platform to fit the shape of the body, confering the ability to roll in any direction, etc.

For example, U.S. Pat. No. 5,174,592 to Pool discloses a closed loop unitary metal frame surrounding the platform and supported by heavy duty casters recessed at spaced intervals in the frame.

U.S. Design Patent 270,962 issued to Kichener discloses a combination creeper and tool caddy in which the tool caddy is fixed at a location on the edge of the platform.

None of the disclosed creepers provide the degree of convenience that characterizes the present invention in terms of assembling the tools and parts in preparation for making repairs at the underside of an automobile.

SUMMARY

This invention is directed toward a creeper including a platform mounted on casters and having a pair of parallel rails, each rail being attached to an edge of the platform opposite the other rail. One or more trays are provided which may be slidably and detachably hooked onto either rail. The detachable feature enables the mechanic to attach more than one tray to either rail. Large trays have an "outrigger" caster attached to provide extra support for large parts or tools. In a first embodiment, each rail is located substantially coplanar with the platform and outside the perimeter of the platform. In a second embodiment, each rail is located next to the underside of the platform. In a third embodiment, the tray is located on the topside of the platform and forms a recess area with the platform for retaining a cushion. The casters are mounted in the ends of the rails thereby providing an economic and sturdy construction as well as a design with reduced overall height of the creeper.

DRAWINGS

DESCRIPTION OF A PREFERRED EMBODIMENT

Figure 1:
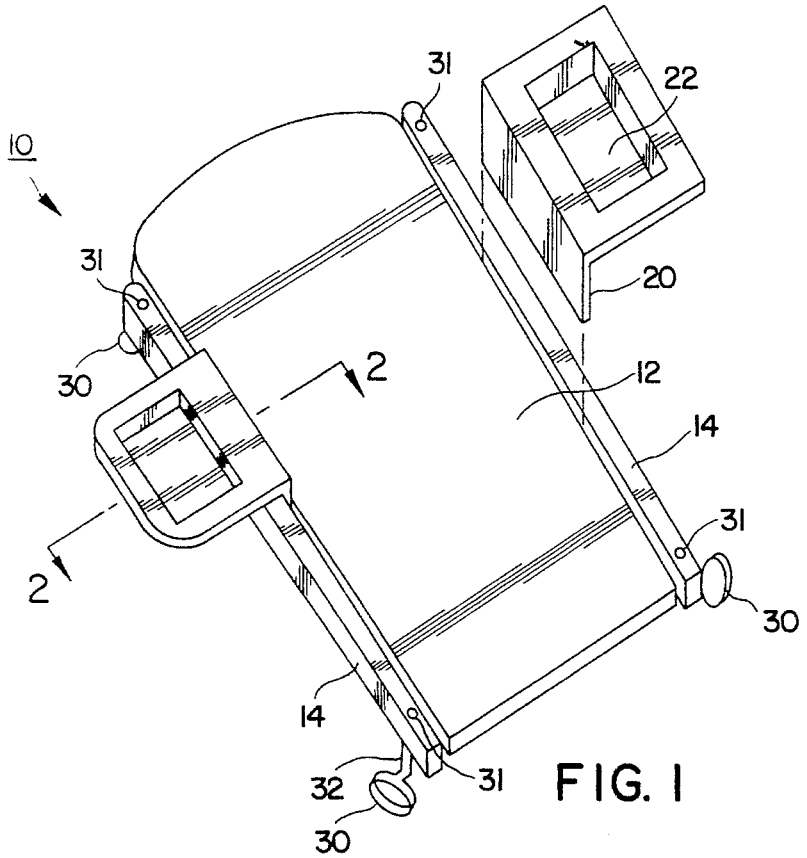
FIG. 1 is a perspective view of the creeper with detachable trays.

Turning now to a discussion of the drawings, FIG. 1 shows an assembly view of a first embodiment 10 of the invention including a platform 12 having a pair of rails 14 attached on opposite edges of the platform 12. Each rail 14 is spaced by spacers (not shown) from its respective platform edge as shown in the sectional view of FIG. 2. The spacing 18 is selected to permit detachably engaging a lip 20 of a tray 22.

Figure 2:
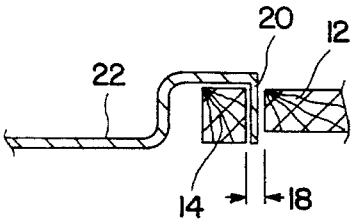
FIG. 2 is a sectional view showing the rails outside the plan of the platform.

In one embodiment, as shown in the sectional cutaway view of FIG. 2, the rails 14 may be secured outside the perimeter of the platform.

Figure 3:
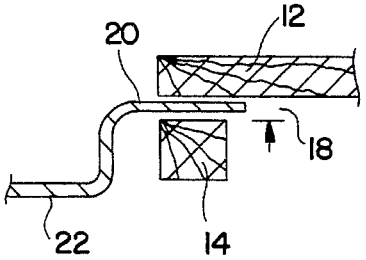
FIG. 3 is a sectional view showing the rails at the underside of the platform.

FIG. 3 is a sectional cutaway view showing the rail 14 positioned on the underside of the platform.

Figure 4:
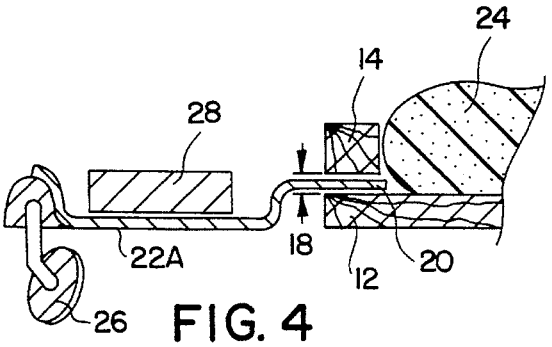
FIG. 4 is a sectional view showing the rails on the topside of the platform.

FIG. 4 shows the rail positioned on the top surface of the platform 12. In this embodiment, a cushion 24 is positioned on the platform between the rails 14.

FIG. 4 also shows a tray 22A having an "outrigger" caster 26 which provides support to tray 22A for carrying heavy parts 28.

FIG. 1 shows that in all of the embodiments, FIGS. 2, 3, 4, the shafts 32 of the casters 30 may be attached to the ends of the rails 14 by insertion into bars 31.

The detachable feature of each individual tray enables the mechanic to attach more than one tray to either rail so that the mechanic may select the size and shape of his tray according to the job and conveniently fill his tray with the required parts at his bench prior to attaching the tray to the rail on the creeper. One tray may be comparatively large and provided with its own caster so that the mechanic can place a relatively large heavy part such as a clutch plate on one tray. The tray for this purpose has its own "outrigger" caster provided to support the extra weight of the part. Another tray may be a much smaller tray with compartments for carrying nuts and bolts. The ability to reposition the tray by sliding it on the rail is a useful feature that enables the mechanic to reposition the tray while he is working on the job to an an easily accessible position and then an "out-of-the-way" position at various stages of the job.

Various other modifications may occur to the reader after studying the drawings and reading the specification which are within the scope of the invention. I therefore wish to define the scope of my invention by the appended claims.

I claim:

1. A creeper for an auto mechanic which comprises:

a platform with a first surface opposite a second surface and having two straight parallel edges bounding said first and second surface;

caster means adapted for rollably supporting said platform on a horizontal surface such that said first surface faces said horizontal surface;

a pair of rails;

means for securing each rail adjacent to one of said two edges opposite said other edge and spaced from said one of said two edges such as to form a slot having a width between said rail and said edge adjacent to said rail;

at least one tray having a lip;

said at least one tray having a configuration, said configuration and said width selected in operable combination with one another such that said lip is detachably engagable with said slot at an arbitrary location along said rail such that, when said platform is supported on said horizontal surface, said tray with lip engaged in said slot is adapted for holding tools.

2. A creeper as in claim 1 wherein each rail of said pair of rails is secured to said platform outside a perimeter of said platform.

3. A creeper as in claim 1 wherein each rail of said pair of rails is secured to said platform on said first surface of said platform.

4. A creeper as in claim 1 wherein each rail of said pair of rails is secured to said platform on said second surface of said platform.

5. A creeper as in claim 4 which comprises a cushion supported on said second surface of said platform operably adapted to support said mechanic when said platform is supported on said horizontal surfce.

6. A creeper as in claim 1 wherein at least one of said at least one tray comprises:

an edge opposite said lip;

an outrigger caster secured to said tray proximal to said edge opposite said lip and adapted for supporting said at least one of said at least one tray on said horizontal surface when said platform is supported on said horizontal surface and said lip of said at least one tray is engaged in one of said slots.

7. A creeper as in claim 1 wherein:

each said rail has a plurality of bores; and said caster means comprises:

a plurality of casters, one said caster for each one of said plurality of bores;

each caster of said plurality of casters, having a stem with one end secured to a wheel and a second end inserted into said respective bore such that a rim of said wheel is enabled to support said platform on said horizontal surface.

* * * * *